United States Patent [19]

Tervidis

[11] 4,133,387

[45] Jan. 9, 1979

[54] MOUNTING DEVICE FOR SPRINKLER HEAD

[76] Inventor: Edward Tervidis, Gager Hill Rd., Scotland, Conn. 06264

[21] Appl. No.: 822,946

[22] Filed: Aug. 8, 1977

[51] Int. Cl.[2] ..... A62C 37/08

[52] U.S. Cl. ..... 169/51; 169/37; 239/282

[58] Field of Search ..... 169/51, 37, 38, 39, 169/40, 41; 239/211, 282, 283

[56] References Cited

U.S. PATENT DOCUMENTS

| | | | |
|---|---|---|---|
| 1,331,277 | 2/1920 | Ramsey | 169/51 |
| 2,611,645 | 9/1952 | Forman | 239/211 X |

*Primary Examiner*—John J. Love

*Attorney, Agent, or Firm*—McCormick, Paulding & Huber

[57] ABSTRACT

A conventional sprinkler head is conveniently connected to a household water pipe for installation over a wood burning stove or the like by means of a short length of conduit, or tubing, with a "quick-tee" connection, and the plaque has a forwardly projecting channel through which the conduit passes to an elbow fitting mounted at the forward end of the channel. The sprinkler head is supported on the elbow, and a decorative figurine is mounted on the deflector portion of the sprinkler head. The figurine is spaced forwardly of the plaque to provide a decorative device suitable for residential installation of a sprinkler head over a wood burning stove or the like, the device being so constructed that the sprinkler head itself is not readily visible.

5 Claims, 4 Drawing Figures

MOUNTING DEVICE FOR SPRINKLER HEAD

SUMMARY OF THE INVENTION

This invention relates generally to mounting devices for sprinkler heads, and deals more particularly with an improved mounting device for a sprinkler head for use in the home, particularly over a wood burning stove.

The principle aim of the present invention is to provide an improved mounting device for a sprinkler head such that the home owner can install the device using only household tools such as a hand drill, wrench, screwdriver and pliers. The device is well adapted to be sold in kit form with a length of copper tubing included, and a "quick-tee" fitting for tapping into a household water pipe. The sprinkler head is preferably of conventional construction, and is threadably received on an elbow. The elbow is secured in a sheet metal channel and the channel is mounted to a plaque, which plaque is adapted to be either hung on the wall over the stove, or provided on a mantle or the like above a fireplace stove. A forwardly projecting sheet metal channel provided at the bottom of the plaque houses a portion of the copper tubing which provides communication between the elbow and the "quick-tee" fitting tapped into the household water pipe. The sprinkler head is of conventional construction and includes a deflector mounted on a yoke or frame thereof and this deflector is utilized to support a figurine, preferably in the form of an eagle, in order to provide decorative display which is not readily seen by the casual observer to constitute a mounting device for a sprinkler head.

DETAILED DESCRIPTION

Figure 1:
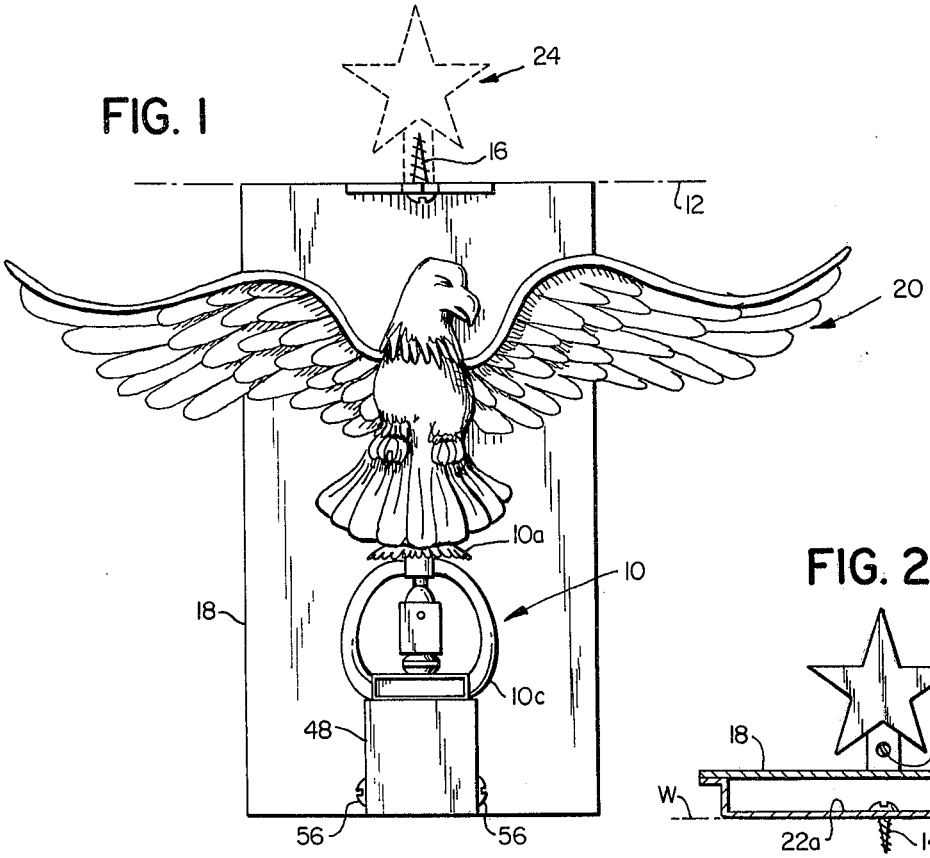
FIG. 1 is a front elevational view illustrating the sprinkler head mounting device of the present invention provided at the juncture between a wall and ceiling, this juncture being indicated by the phantom line, and also illustrating an upper portion of the device in broken lines in an alternative configuration wherein the plaque is adapted to be mounted on a wall spaced below such ceiling.

Turning now to the drawing in greater detail, FIG. 1 shows a preferred form for the device of the present invention, supporting a sprinkler head 10 at the juncture between a wall and ceiling indicated generally by the broken line 12. The device is adapted to be secured to the wall by a screw 14, best shown in FIGS. 2 and 3, but may also be secured to the ceiling by an additional screw 16 best shown in FIGS. 1 and 2.

Figure 2:
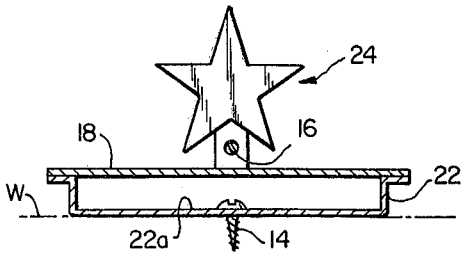
FIG. 2 is a plan view of the device illustrated in FIG. 1, with the wall being illustrated in phantom lines.
Figure 3:
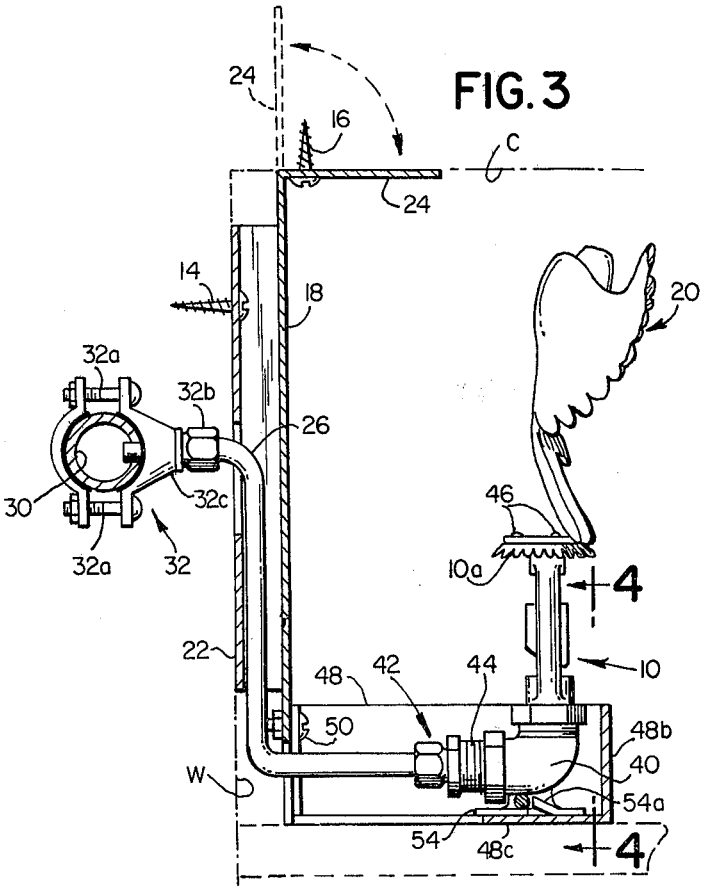
FIG. 3 is a side elevational view of the device illustrated in FIG. 1, with an upper portion thereof being illustrated in broken lines to illustrate the configuration of the device as mounted on a wall, and with this portion of the device being illustrated in solid lines to illustrate mounting of the device at the interface between a wall and a ceiling (the latter being again illustrated in phantom lines). Alternatively, the device might be mounted on a mantle, the latter being illustrated in broken lines as supporting the device from below.

The device includes a generally rectangular plaque 18, which plaque may have a seal or other decorative emblem imprinted thereon or may simply be painted a flat black color to better accentuate the figurine 20 provided on the sprinkler head deflector **10*a* in a manner to be described. The rectangular plaque 18 includes a channel shaped member 22 mounted to the rear side thereof, by tack welding or the like, to space the plaque 18 from the wall, indicated generally at W in FIG. 2. The vertically extending web portion of the channel 22 indicated generally at 22*a* preferably includes a key shaped opening for receiving the screw 14 in order to permit the device to be conveniently mounted to the wall as shown. A star shaped appendage 24 is attached to the upper portion of the plaque 18 and may be either vertically orientated, as indicated by the broken lines in FIG. 1, where the plaque 18 is to be mounted on the wall generally, or said appendage 24 may be bent 90 degrees to the plaque 18 so as to permit the device to be mounted at the junction between the wall W and ceiling C as best shown in FIGS. 2 and 3. The channel shaped support 22 for the plaque 18 provides a convenient receptacle for routing a length of copper tubing 26**, which may be provided with the device itself in order to provide a convenient kit for the householder so that he can install this device with the aid of household tools.

The homeowner need only locate his household water pipe 30, which pipe may comprise a one-half inch copper water-pipe or other standard size pipe, and by use of a conventional "quick-tee" fitting sized for the particular water pipe involved the homeowner may tap into the water pipe as illustrated at 32 in FIG. 3. When tapping into a copper water pipe such a tee fitting does not usually require a drill, or that the water be shut off. The homeowner need merely attach the valve, by means of the screws **32*a* as shown, and use a tool or fitting (not shown) provided with such "quick-tee" so as to pierce the copper pipe. For tapping iron water pipes it is recommended that the water supply be shut off, and a 3/16 inch hole drilled into the pipe (with an electric drill if properly grounded). The saddle part 32*c*** is preferably tightened by means of this tool or fitting (normally provided with such "quick-tee" fittings) and the reader is referred to Part No. 520C sold by Chicago Specialty Manufacturing Company of Skokie, Ill. 60076, for a recommended "quick-tee" fitting for this purpose.

Figure 4:
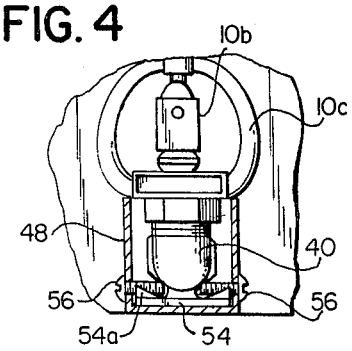
FIG. 4 is a sectional view taken generally on the line 4—4 of FIG. 3.

As shown in FIG. 3 the length of copper tubing 26 is conventionally attached to the fitting **32*b* provided for this purpose with the "quick-tee" fitting, and the copper tubing, bent as required connects at its other end with an elbow fitting 40. The elbow 40 is provided with the kit described herein and has one end sized to receive a conventional sprinkler head 10. A compression fitting 42 is provided together with an adapter 44 for connecting the end of the copper tubing 26 with the elbow 40 as best shown in FIG. 3. Thus, a continuous supply of water is available to the sprinkler head 10 with the valve in the sprinkler head being held closed by fusible link 10*b*, best shown in FIG. 4. The sprinkler is preferably a conventional component, and also includes a yoke or frame portion 10*c*, which yoke preferably supports a deflector 10*a* for directing water downwardly in a 360° spray pattern. In accordance with the present invention a figurine 20 is attached to this deflector 10*a* by rivets or the like, as indicated generally at 46 in FIG. 3**.

The rectangular plaque 18 together with its associated rearwardly extending channel 22 provides a convenient space for housing the copper tubing 26 but it will be noted that a portion of this tubing extends forwardly of the plaque as best shown in FIG. 3. In accordance with the present invention a channel spaced, bent sheet metal member 48, is provided on the plaque 18 to not only hide the tubing 26, but the channel shaped member 48 also supports the elbow 40, and thereby provides support for the sprinkler head 10 and the figurine 20. This channel shaped member 48 is mounted to the lower portion of the front surface of the plaque 18 by one or more screws, as indicated at 50 in FIG. 3, and preferably includes a front wall **48*b* so that as viewed from the front in FIG. 1 an observer only sees the circular portion of the yoke or frame 10*c* of the sprinkler head. The internal elbow 40 is obsecured from view by the front wall 48*b***.

Means is provided for attachment of the elbow 40 inside the channel 48, and preferably said attachment means takes the form of a generally rectangular flange 54 which is welded to the elbow fitting, and which rests on the lower wall **48*c* of the channel 48. This flange 54 includes raised tabs which cooperate with laterally extending screws best shown in FIG. 4 at 56, which screws cooperate with the raised tabs 54*a* of the flange 54** in order to secure the elbow fitting in place.

I claim:

1. A decorative device for supporting a sprinkler head, said device comprising:

(a) a plaque having rearwardly projecting spacer means defining a cavity for housing a length of conduit which is adapted to be connected to a houshold water pipe or the like, (b) a forwardly projecting channel mounted to the front surface of said wall plaque adjacent the lower side edge thereof, and adapted to house the end portion of said conduit, (c) elbow fitting means adapted to be connected to the end of said conduit and having attachment means for securing said elbow means in said channel, (d) a sprinkler head threadably received in said elbow fitting means, said sprinkler head including a frame to support the upper end of a fusible link such that the lower end supports the sprinkler head valve to hold it closed, and a deflector on said frame to direct the upwardly discharged water through 360° in a conventional spray pattern, and (e) a decorative figurine mounted to said deflector and located above the sprinkler head in front of said plaque.

2. The device according to claim 1 wherein said plaque comprises a generally rectangular plate and said spacer means comprises a channel shaped member with flanges for attachment to the rear surface of the plate.

3. The device according to claim 2 wherein said forwardly projecting channel has an end plate in the forward end thereof, and said channel being upwardly open with a bottom wall which defines opening means between said plate and said elbow fitting attachment means.

4. The device according to claim 3 wherein said elbow fitting attachment means comprises a rectangular flange welded to said elbow fitting and resting on said bottom wall of said upwardly open channel.

5. The device according to claim 4 wherein screw means is provided in the side wall of said channel above said elbow flange to secure said elbow in said channel.

* * * * *